US010755683B1

(12) United States Patent
Baltazor

(10) Patent No.: US 10,755,683 B1
(45) Date of Patent: Aug. 25, 2020

(54) TRANSFORMATION OF SOUND TO VISUAL AND/OR TACTILE STIMULI

(71) Applicant: Shawn Baltazor, Los Angeles, CA (US)

(72) Inventor: Shawn Baltazor, Los Angeles, CA (US)

( * ) Notice: Subject to any disclaimer, the term of this patent is extended or adjusted under 35 U.S.C. 154(b) by 0 days.

(21) Appl. No.: 16/266,035

(22) Filed: Feb. 2, 2019

(51) Int. Cl.
*G10H 1/00* (2006.01)
*G10H 1/36* (2006.01)

(52) U.S. Cl.
CPC ..... *G10H 1/368* (2013.01); *G10H 1/0008* (2013.01); *G10H 2210/066* (2013.01)

(58) Field of Classification Search
CPC ..... G10H 1/368; G10H 1/0008
See application file for complete search history.

(56) References Cited

U.S. PATENT DOCUMENTS 3,698,277 A * 10/1972 Barra ..... G09B 15/02 84/483.1
6,127,616 A * 10/2000 Yu ..... G09B 15/026 84/483.1
6,411,289 B1 * 6/2002 Zimmerman ..... G09B 15/00 345/419
6,659,773 B2 * 12/2003 Roy ..... A47C 3/02 434/55
6,686,529 B2 * 2/2004 Kim ..... G06T 11/001 704/E21.019
6,694,035 B1 * 2/2004 Teicher ..... A61F 11/045 381/326
6,791,568 B2 * 9/2004 Steinberg ..... G10H 1/0008 345/600
6,831,220 B2 * 12/2004 Varme ..... G10G 1/00 84/464 R
7,589,727 B2 * 9/2009 Haeker ..... G10H 1/0008 345/440
7,956,273 B2 * 6/2011 Lemons ..... G09B 15/009 84/483.2
7,960,637 B2 * 6/2011 Lemons ..... G10L 21/06 84/464 R
7,981,064 B2 * 7/2011 Oser ..... A47C 7/72 601/46
8,761,417 B2 * 6/2014 Oser ..... H04R 5/023 381/152
9,552,741 B2 * 1/2017 Granger ..... G09B 15/023
10,152,296 B2 * 12/2018 Trestain ..... H04R 5/023
10,290,291 B2 * 5/2019 Tsuda ..... G06F 3/165
10,325,580 B2 * 6/2019 Scallie ..... G10H 1/0008
2002/0176591 A1 * 11/2002 Sandborn ..... G09B 15/02 381/118
2017/0290436 A1 * 10/2017 Welsh ..... H04R 1/028
(Continued)

OTHER PUBLICATIONS

CymaScope, Music Made Easy app demo, YouTube, Apr. 5, 2016.*
(Continued)

*Primary Examiner* — Robert W Horn
(74) *Attorney, Agent, or Firm* — Garrett IP

(57) ABSTRACT

Methods and systems to transform human-perceptible acoustic vibrations (e.g., music) to human perceptible electromagnetic radiation (i.e., human perceptible colors and/or cymatic images), and/or to human perceptible tactile vibrations, based on pitch classes of tones contained within the acoustic vibrations.

20 Claims, 13 Drawing Sheets

(56) References Cited

U.S. PATENT DOCUMENTS

| | | | | |
|---|---|---|---|---|
| 2019/0066607 | A1* | 2/2019 | Mitchell | G09G 3/346 |
| 2019/0164529 | A1* | 5/2019 | Kafuku | G06T 13/80 |

OTHER PUBLICATIONS

Advertisement for "Cymascope, Sound Made Visible" application, accessed from https://www.cymascope.com/cyma_research/cyma_app.html, Jan. 9, 2019.

* cited by examiner

100

| Pitch Class | Octave | | | | | | | | | 102 EM Frequency (THz) | 104 Tactile Frequency (HZ) |
|---|---|---|---|---|---|---|---|---|---|---|---|
| | 1 | 2 | 3 | 4 | 5 | 6 | 7 | 8 | 9 | | |
| F♯/G♭ | 46.249 | 92.499 | 185 | 369.99 | 739.99 | 1480 | 2960 | 5919.9 | 11840 | 406.81 | 46.249 |
| G | 48.999 | 97.999 | 196 | 392 | 783.99 | 1568 | 3136 | 6271.9 | 12544 | 431 | 48.999 |
| A♭/G♯ | 51.913 | 103.83 | 207.65 | 415.3 | 830.61 | 1661.2 | 3322.4 | 6644.9 | 13289.8 | 456.63 | 51.913 |
| A | 55 | 110 | 220 | 440 | 880 | 1760 | 3520 | 7040 | 14080 | 483.79 | 55 |
| B♭/A♯ | 58.27 | 116.54 | 233.08 | 466.16 | 932.33 | 1864.7 | 3729.3 | 7458.6 | 14917 | 512.55 | 58.27 |
| B | 61.735 | 123.47 | 246.94 | 493.88 | 987.77 | 1975.5 | 3951.1 | 7902.1 | 15804 | 543.03 | 61.735 |
| C | 65.406 | 130.81 | 261.63 | 523.25 | 1046.5 | 2093 | 4186 | 8372 | 16744 | 575.32 | 65.406 |
| C♯/D♭ | 69.296 | 138.59 | 277.18 | 554.37 | 1108.7 | 2217.5 | 4434.9 | 8869.8 | 17740 | 609.53 | 69.296 |
| D | 73.416 | 146.83 | 293.66 | 587.33 | 1174.7 | 2349.3 | 4698.6 | 9397.3 | 18795 | 645.78 | 73.416 |
| E♭/D♯ | 77.782 | 155.56 | 311.13 | 622.25 | 1244.5 | 2489 | 4978 | 9956.1 | 19912 | 684.18 | 77.782 |
| E | 82.407 | 164.81 | 329.63 | 659.26 | 1318.5 | 2637 | 5274 | 10548 | 21096 | 724.86 | 82.407 |
| F | 87.307 | 174.61 | 349.23 | 698.46 | 1396.9 | 2793.8 | 5587.7 | 11175 | 22351 | 767.96 | 87.307 |

FIG. 1

| Tone | Frequency (Hz) (602) | Note/Pitch (604) | Harmonic Relationship (606) |
|---|---|---|---|
| 402 | 440 | $A_4$ | Fundamental Tone |
| 404 | 880 | $A_5$ | 1st Octave |
| 406 | 1320 | $E_5$ | Perfect 5th |
| 408 | 1760 | $A_6$ | 2nd Octave |
| 410 | 2200 | $C\#_6$ | Major 3rd |
| 412 | 2640 | $E_6$ | Perfect 5th |
| 414 | 3080 | $G_7$ | b7th |

1000

1002

| Tone | Frequency (Hz) | Note/Pitch | Visible Spectrum (THz) |
|---|---|---|---|
| 902a | 440 | $A_4$ | 483.79 |
| 902b | 880 | $A_5$ | 483.79 |
| 902c | 1320 | $E_5$ | 724.86 |
| 902d | 1760 | $A_6$ | 483.79 |
| 902e | 2200 | $C\#_6$ | 609.53 |
| 902f | 2640 | $E_6$ | 724.46 |
| 902g | 3080 | $G_7$ | 431 |

FIG. 10

1100

1002 1102

| Tone | Frequency (Hz) | Note/Pitch | Visible Spectrum (THz) | Tactile Spectrum (Hz) |
|---|---|---|---|---|
| 902a | 440 | $A_4$ | 483.79 | 440 |
| 902b | 880 | $A_5$ | 483.79 | |
| 902c | 1320 | $E_5$ | 724.86 | |
| 902d | 1760 | $A_6$ | 483.79 | |
| 902e | 2200 | $C\#_6$ | 609.53 | |
| 902f | 2640 | $E_6$ | 724.46 | |
| 902g | 3080 | $G_7$ | 431 | |

FIG. 11

1200

| Tone | Frequency (Hz) | Note/Pitch | Visible Spectrum (THz) (1002) | Tactile Spectrum (Hz) (1102) |
|---|---|---|---|---|
| 902a | 440 | $A_4$ | 483.79 | 440 |
| 902b | 880 | $A_5$ | 483.79 | 880 |
| 902c | 1320 | $E_5$ | 724.86 | 1320 |
| 902d | 1760 | $A_6$ | 483.79 | 1760 |
| 902e | 2200 | $C\#_6$ | 609.53 | 2200 |
| 902f | 2640 | $E_6$ | 724.46 | 2640 |
| 902g | 3080 | $G_7$ | 431 | 3080 |

FIG. 12

TRANSFORMATION OF SOUND TO VISUAL AND/OR TACTILE STIMULI

BACKGROUND

Synesthesia is a perceptual phenomenon in which stimulation of a sensory or cognitive pathway leads to automatic, involuntary experiences in another sensory or cognitive pathway. Chromesthesia is a form of synesthesia in which a sound automatically and involuntarily evokes an experience of color. It would be useful to evoke a synesthesia-like effect in a person who does not normally experience synesthesia, such so to evoke a chromesthesia-like effect and/or an auditory-tactile-like synesthesia in response to a complex sound, such as music.

Cymatics is a subset of modal vibrational phenomena in which in a thin coating of particles, paste, or liquid is placed on the surface of a plate, diaphragm or membrane (e.g., a Chladni plate). When the plate is vibrated, regions of maximum and minimum displacement are made visible as patterns in the particles, paste, or liquid. The patterns vary based on the geometry of the plate and the frequency of vibration. It would be useful to provide cymatic effects in response to complex sound, such as music.

BRIEF DESCRIPTION OF THE DRAWINGS/FIGURES

FIG. 1 is a table that lists example frequencies of musical notes.

FIG. 10 is a table that lists frequencies and notes/pitches of selected tones of FIG. 9.

FIG. 11 is a table that includes features of the table of FIG. 10, and further includes an additional column that lists a fundamental frequency of a selected tone at which to stimulate one or more tactile devices.

FIG. 12 is a table in which the additional column of the table of FIG. 10 is further populated with fundamental frequencies of remaining selected tones of FIG. 9.

Figure 2:
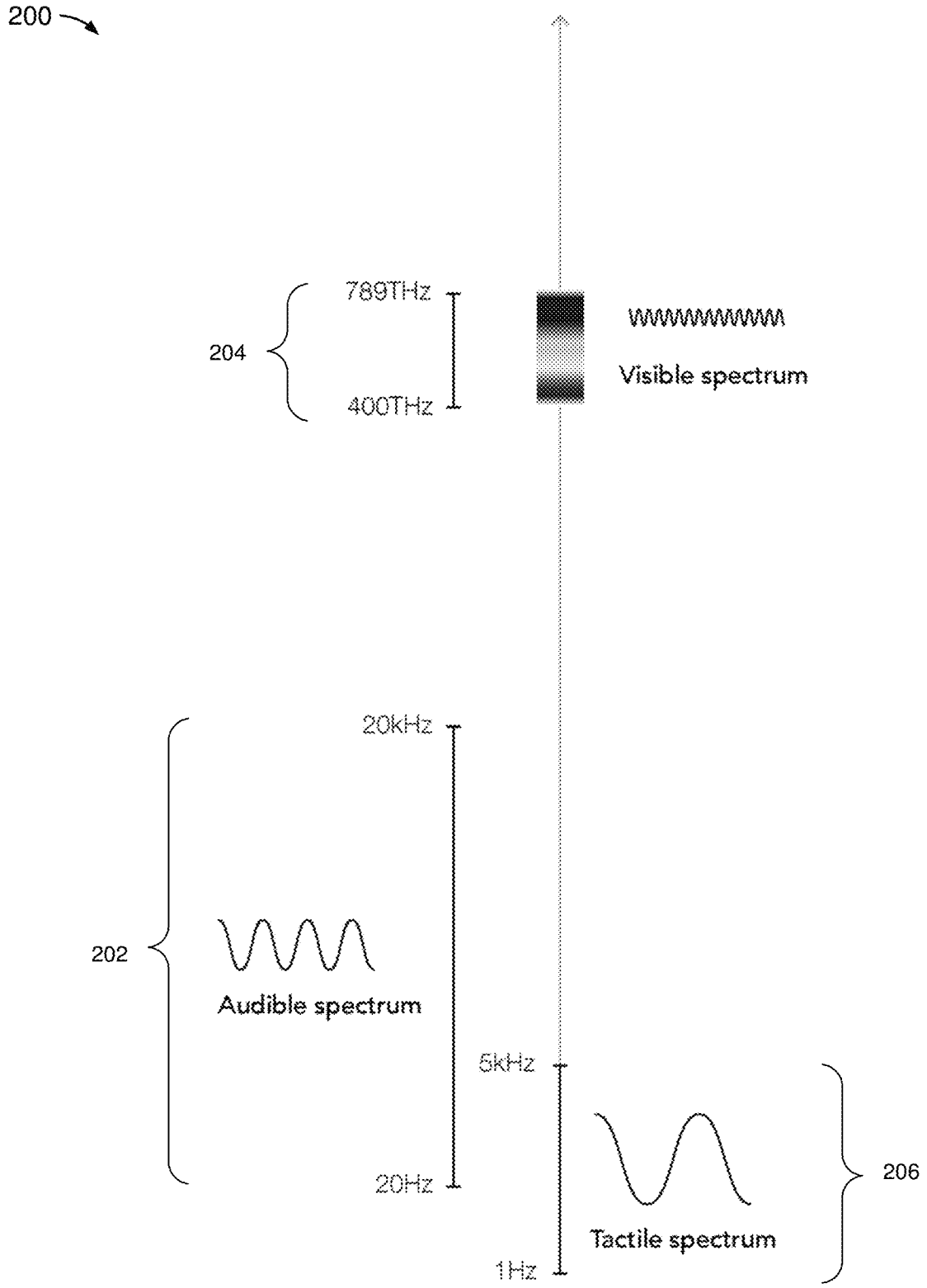
FIG. 2 is a diagram of a continuous frequency spectrum that includes an audible spectrum of sound, a visible spectrum of electromagnetic radiation, and a tactile spectrum of human-perceptible vibrations.

In the drawings, the leftmost digit(s) of a reference number identifies the drawing in which the reference number first appears.

DETAILED DESCRIPTION

A typical person can only hear acoustic waves, or sound, as distinct pitches when the frequency is within a range of approximately 20 Hz to 20 kHz.

A typical human eye is responsive to electromagnetic wavelengths in a range of approximately 390 to 700 nanometers, which corresponds to a frequency band of approximately 430-770 THz.

Mechanoreceptors are sensory receptors within human skin that respond to mechanical pressure or distortion. Mechanoreceptors of a typical person may be sensitive to acoustic waves within a range of approximately 1 Hz to hundreds or thousands of Hz.

Disclosed herein are methods and systems to transform acoustic vibrations (e.g., music) to human perceptible electromagnetic radiation (i.e., human perceptible light/colors), human perceptible tactile vibrations, and/or cymatic forms/shapes.

Methods and systems disclosed herein may be useful to transform human-perceptible acoustic vibrations (e.g., music), into an extended or enhanced-spectrum experience that engages multiple sensory receptors to create a cross-sensory consonance. Through a combination of visual and/or tactile enhancements, pitch, timbre, and rhythm of music may be transposed to other perceivable mediums, such as color and/or vibrations.

Methods and systems disclosed herein may be useful in creating vibrant performances that allow even a non-hearing person to experience music through other sensory receptors.

Methods and systems disclosed herein may be useful as a basis for a music education initiative, bridging the gap between a person's senses, while expanding the person's awareness and ability to utilize this sensory connectivity in everyday life.

Methods and systems disclosed herein may be useful as a stepping stone for further research into the potential of cross-sensory consonance, working toward bridging the gap between hearing and non-hearing experiences.

In music, an octave or perfect octave is an interval between a first musical pitch and a second musical pitch that has half or double the frequency of the first musical pitch. A musical scale may be written with eight notes. For example, the C major scale is typically written C D E F G A B C, and the initial and final Cs are an octave apart. Two notes separated by an octave have the same letter name and are of the same pitch class. Musical notes of the same pitch class are perceived as very similar to one another. A pitch class is a set of all pitches that are a whole number of octaves apart. The pitch class C, for example, includes all Cs in all octaves.

FIG. 1 is a table 100 that lists example frequencies of musical notes for each of nine octaves. In the example of FIG. 1, each octave is divided into twelve pitches or musical notes, {F#/G♭, G, A♭/G# . . . F}. Methods and systems disclosed herein are not, however, limited to nine octaves, twelve pitches per octave, or the example frequencies listed in table 100.

FIG. 2 is a diagram of a continuous frequency spectrum 200 that includes an audible spectrum 202 of sound, a visible spectrum 204 of electromagnetic radiation, and a tactile spectrum 206 of human-perceptible vibrations. As disclosed herein, sounds within audible spectrum 202 are converted to visible spectrum 204, and/or to tactile spectrum 206. Additionally, or alternatively, sounds within audible spectrum 202 may be provided to a cymatic device.

In an embodiment, the frequencies of each octave of FIG. 1 are mapped to respective frequencies of visible spectrum 204 in FIG. 2. In other words, each pitch class of FIG. 1 is mapped to a respective portion of visible spectrum 204. Example audible-to-visible mappings are provided in column 102 of table 100. In this example, a musical note or tone G, of any octave, is mapped to 431 THz (red), of visible spectrum 204. Whereas a tone B, of any octave, is mapped to 543.03 THz (violet) of visible spectrum 204.

Additionally, or alternatively, the frequencies of each octave of FIG. 1 are mapped to respective frequencies of tactile spectrum 206 in FIG. 2. In other words, each pitch class of FIG. 1 is mapped to a respective portion of tactile spectrum 206. Example audible-to-tactile mappings are provided in column 104 of table 100. In this example, a tone of any octave of a given pitch class is mapped to the fundamental frequency of the pitch class (i.e., the column labeled Octave 1 in FIG. 1). Thus, a tone G, of any octave, is mapped to 48.999 Hz of tactile spectrum 206. Whereas a tone B, of any octave, is mapped to 61.735 Hz of tactile spectrum 206.

In the example of FIG. 1, the tactile frequencies listed in column 104 range from 46.249 Hz to 87.307 Hz, corresponding to the range of fundamental frequencies of the pitch classes (i.e., listed in the column labeled Octave 1 in FIG. 1). In another embodiment, the range of tactile frequencies listed in column 104 is expanded to a wider frequency range. This may be useful to provide a more pronounced difference in the vibratory frequencies of adjacent pitch classes.

Additionally, or alternatively, the frequencies and phases of each octave of FIG. 1 are translated into cymatic information. Frequencies of the cymatic spectrum may be selected based on properties of a cymatic device and/or a cymatic imaging computer program.

A complex electrical signal, such as an electrical representation of a sound generated by a musical instrument, typically includes multiple tones, or frequencies, and other distinguishing characteristics. The lowest frequency is referred to as the fundamental frequency. In music, the fundamental frequency is used to name the sound (e.g., the musical note). The fundamental frequency is not necessarily the dominant frequency of a sound. The dominant frequency is the frequency that is most perceptible to a human. The dominant frequency may be a multiple of the fundamental frequency. The dominant frequency for the transverse flute, for example, is double the fundamental frequency. Other significant frequencies of a sound are called overtones of the fundamental frequency, which may include harmonics and partials. Harmonics are whole number multiples of the fundamental frequency. Partials are other overtones. A sound may also include subharmonics at whole number divisions of the fundamental frequency. Most instruments produce harmonic sounds, but many instruments produce partials and inharmonic tones, such as cymbals and other indefinite-pitched instruments.

In music, the term timbre refers to the perception of the harmonic and partial content of a sound. Timbre is directly related to the harmonic content of a sound. Timbre distinguishes sounds from different sources, even when the sounds have the same pitch and loudness. For example, timbre is the difference in sound between a guitar and a piano playing the same note at the same volume. Characteristics of sound that determine the perception of timbre include frequency content and envelope.

Figure 3:
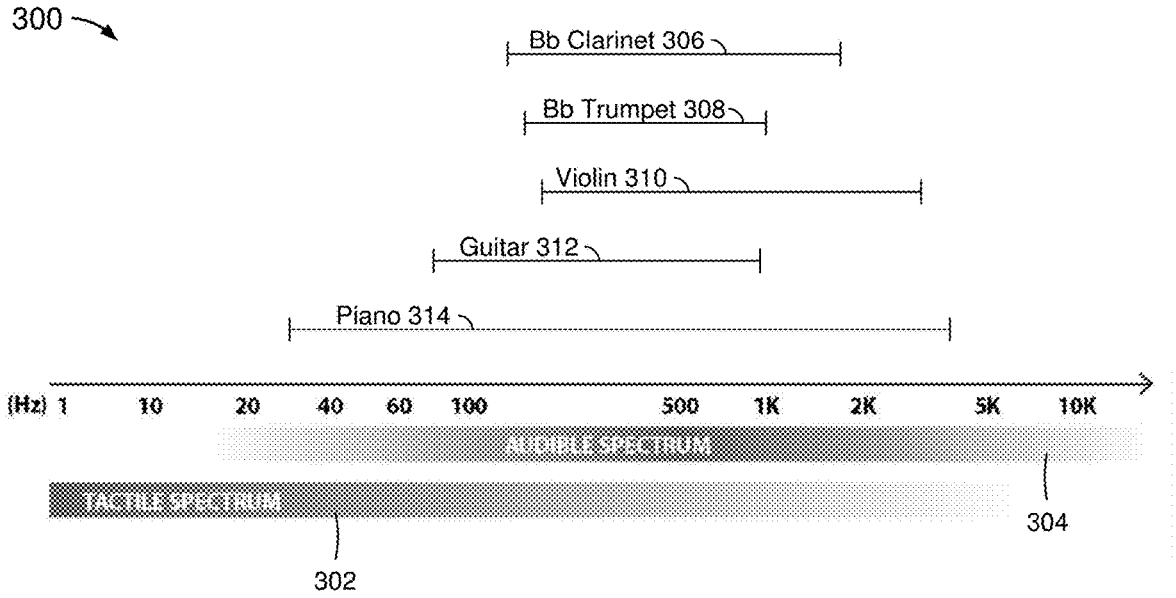
FIG. 3 is a diagram of a typical human-perceptible tactile spectrum, a typical human-perceptible audible spectrum, and frequency ranges of musical instruments.

FIG. 3 is a diagram 300 of a human-perceptible tactile spectrum 302, a human-perceptible audible spectrum 304, and frequency ranges of some common musical instruments. The example frequency ranges include a frequency range 306 of a clarinet, a frequency range 308 of a trumpet, a frequency range 310 of a violin, a frequency range 312 of a guitar, and a frequency range 314 of a piano. As illustrated in FIG. 3, there is overlap between tactile spectrum 302 and audible spectrum 304.

Figure 4:
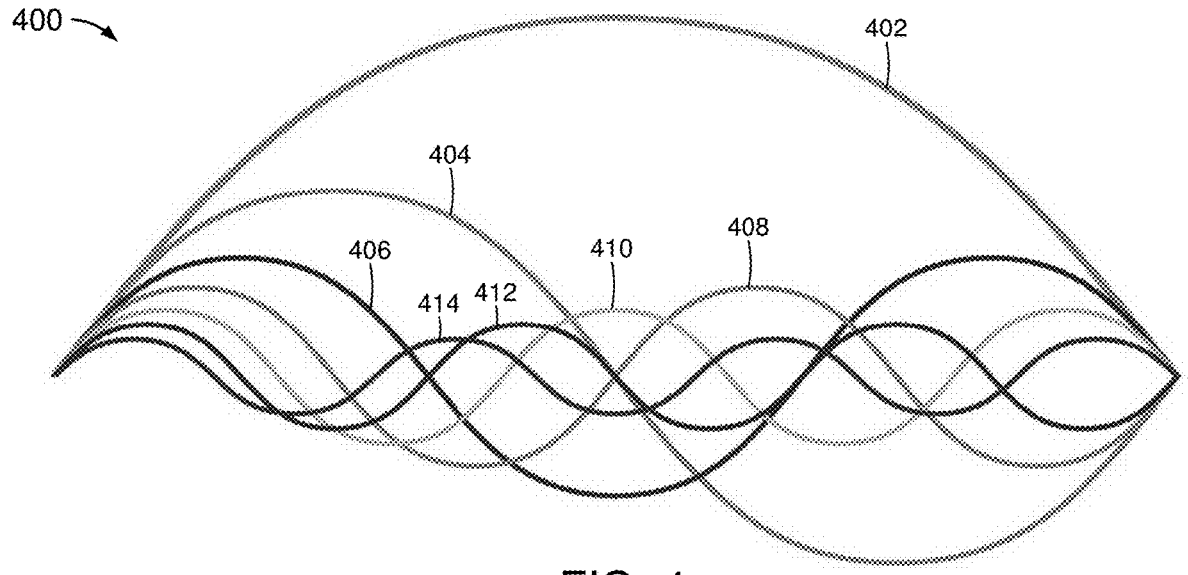
FIG. 4 is a time domain illustration of an example sound that includes a fundamental tone and additional tones (e.g., overtones/harmonics).

FIG. 4 is a time domain illustration of an example sound 400 that includes a fundamental tone 402 and additional tones (e.g., overtones/harmonics) 404, 406, 408, 410, 412, and 414.

Figure 5:
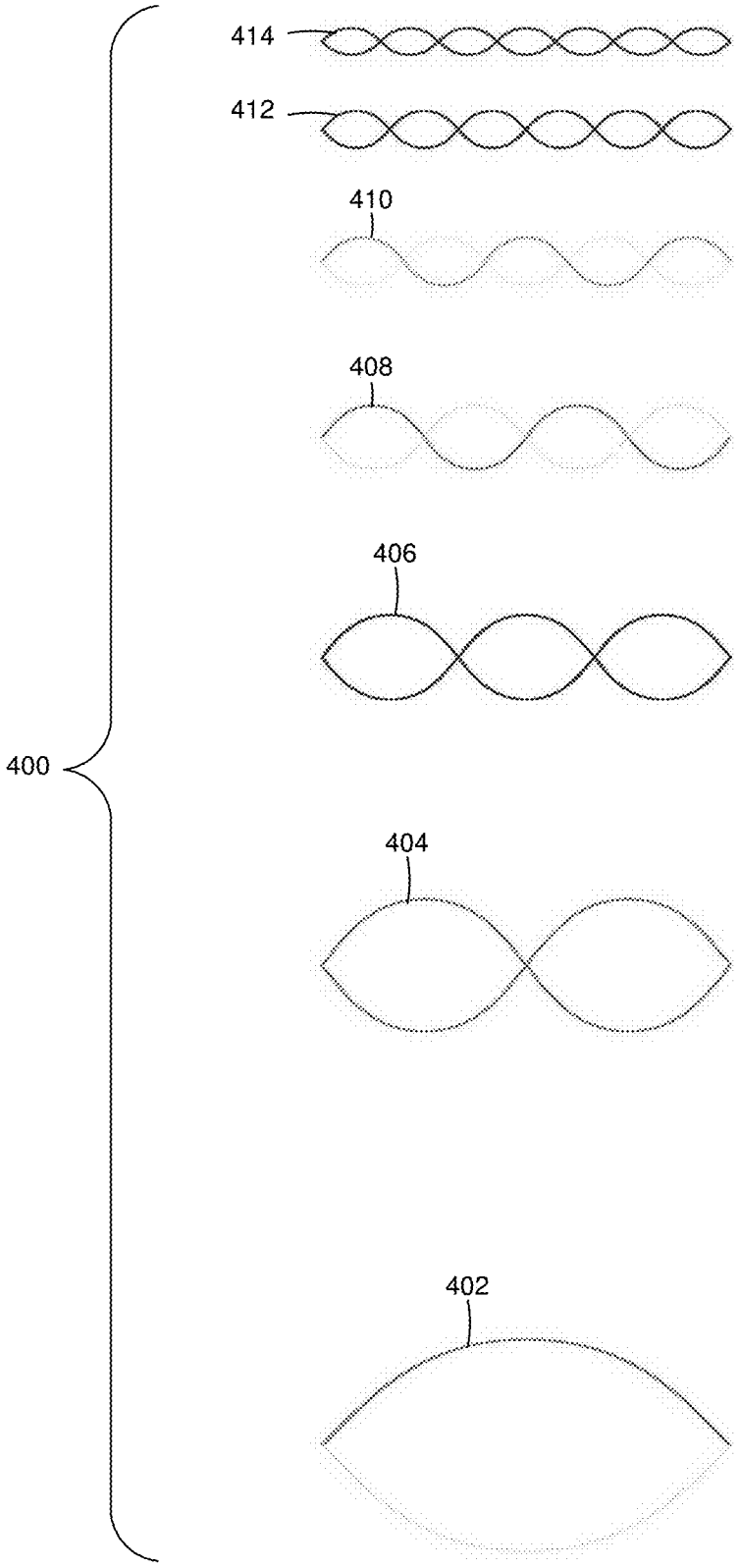
FIG. 5 is a depiction of the tones of the sound of FIG. 4, shown separately from one another for illustrative purposes.

FIG. 5 is a depiction of the tones of sound 400, shown separately from one another for illustrative purposes. Sound 400 may be recreated by recreating its sinusoidal parts, 402 through 414.

Figures 6, 7:
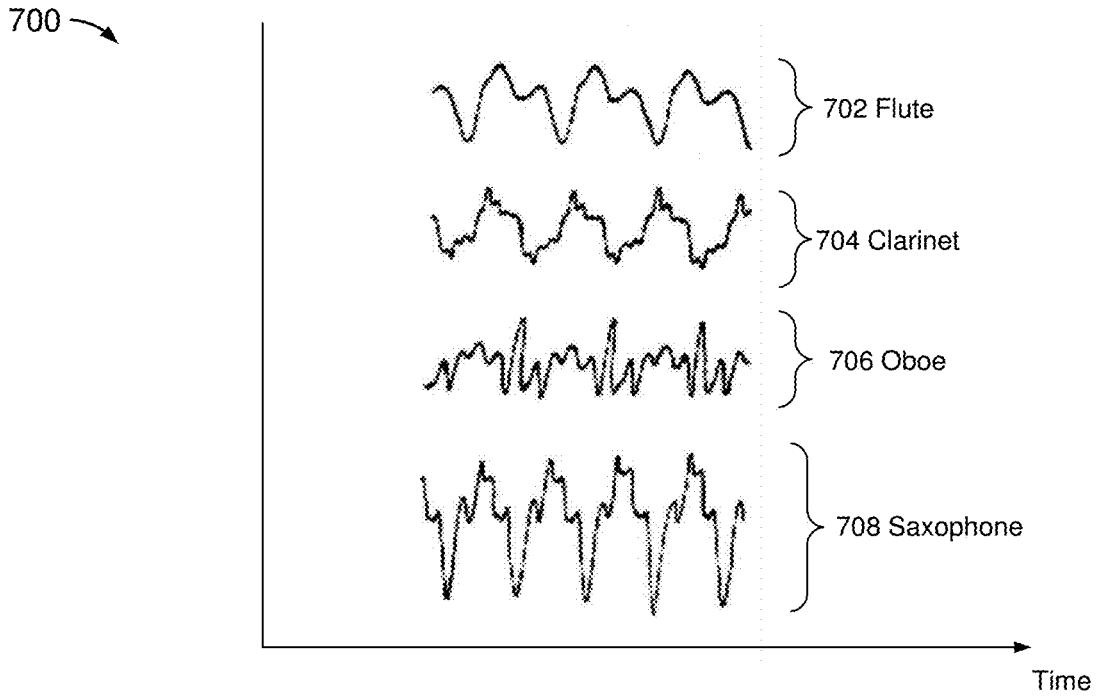
FIG. 6 is a table listing frequencies of the tones of the sound of FIG. 4, corresponding notes/pitches, and harmonic relationships.
FIG. 7 is a time domain illustration of sound envelopes generated by various instruments.

FIG. 6 is a table 600 listing frequencies 602 of tones 402 through 414 of sound 400, along with corresponding notes/pitches 604 and harmonic relationships 606. In the example of FIG. 6, notes/pitches 604 include subscript notations to designate octaves of the respective tones.

An overall shape of a sound, in the time domain, is referred to as an envelope of the sound. FIG. 7 is a time domain illustration 700 of sounds generated by various instruments. Illustration 700 includes envelopes 702 of sound generated by a flute, envelopes 704 of sound generated by a clarinet, envelopes 706 of sound generated by an oboe, and envelopes 708 of sound generated by a saxophone.

As disclosed herein, where a sound includes multiple tones at a given time, a predetermined number of the tones is transformed from audible spectrum 202 to visible spectrum 204 (FIG. 2), tactile spectrum 206 (FIG. 2), and/or a cymatic information, based on the pitch class of the respective tones. Examples are provided below.

Figure 8:
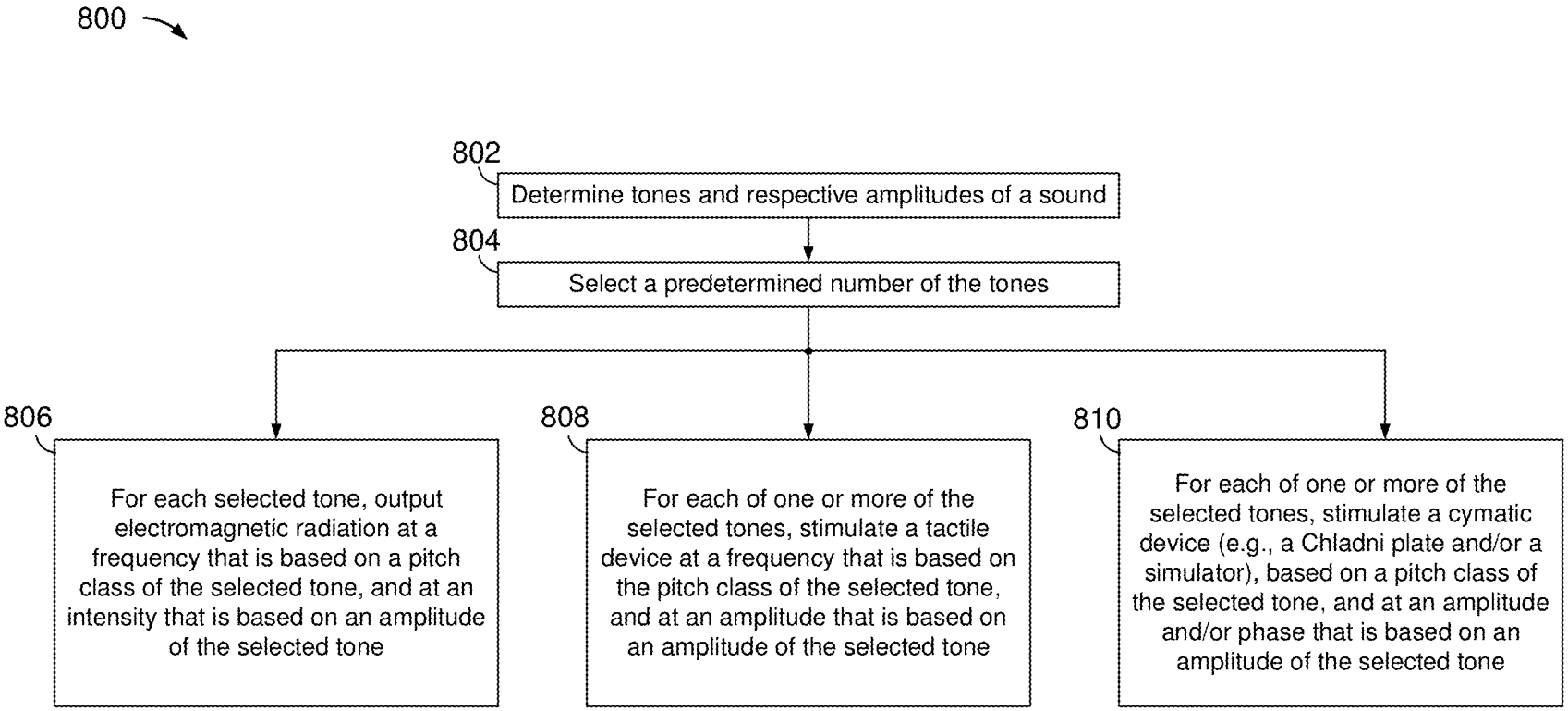
FIG. 8 is a flowchart of a method of transforming sound to visual, tactile, and/or cymatic stimuli.

FIG. 8 is a flowchart of a method 800 of transforming sound to visual and/or tactile stimuli.

At 802, tones of a sound, and corresponding amplitudes, are determined. An example is provided below with reference to FIG. 9.

Figure 9:
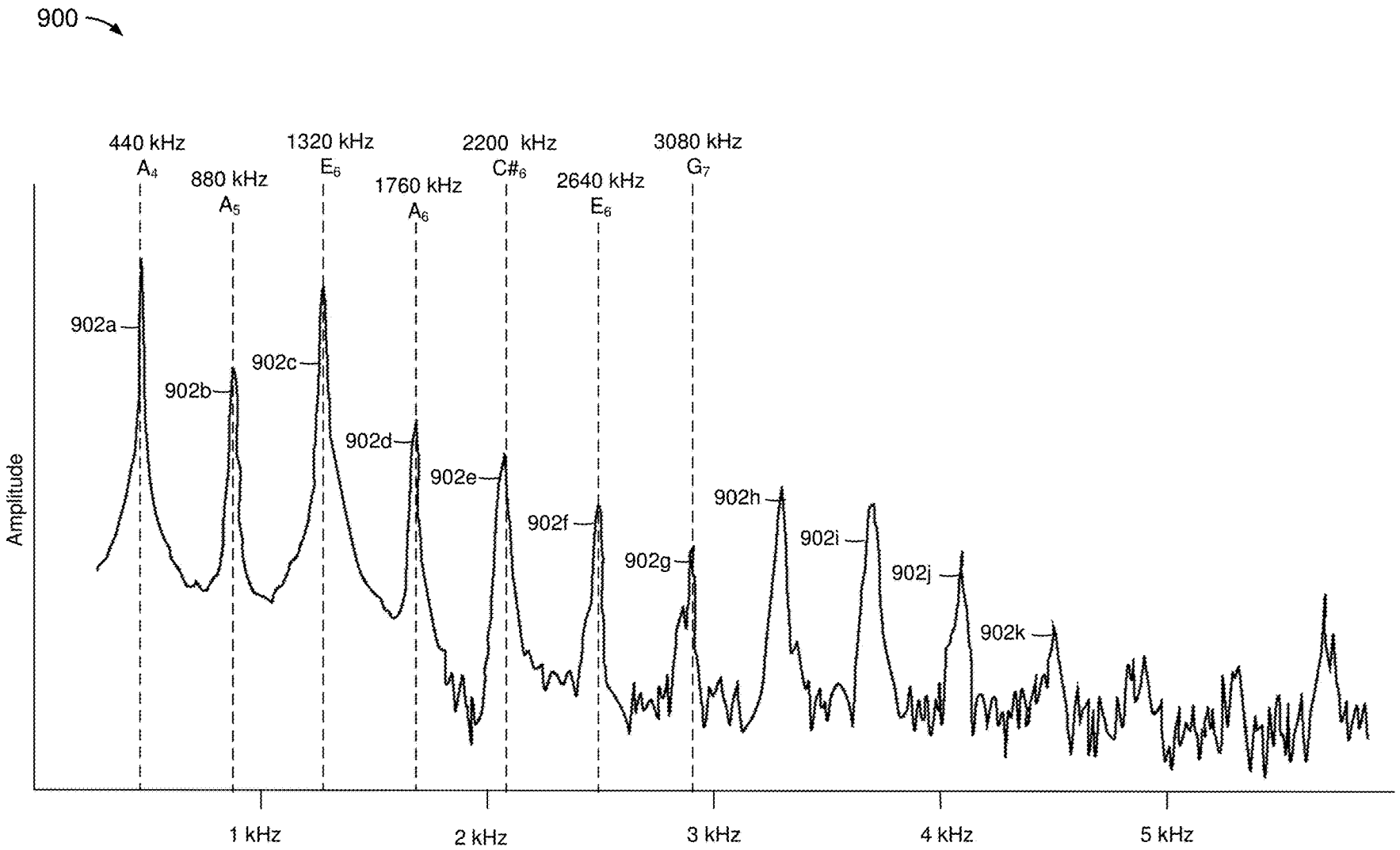
FIG. 9 is a frequency domain representation of example tones contained within a sound generated by a flute.

FIG. 9 is a frequency domain representation 900 of example tones contained within a sound generated by a flute. Frequency domain representation 900 may also be referred to as a frequency spectrum 900 of the sound. Frequency spectrum 900 includes multiple amplitude peaks, or tones 902. Tones 902 may be detected with a Fast Fourier Transform.

At 804, a predetermined number of the detected tones is selected for mapping to visible spectrum 204 (FIG. 2), tactile spectrum 206 (FIG. 2), and/or to cymatic information. As an example, seven tones of FIG. 9 (e.g., tones 902*a* through 902*g*), may be selected.

At 806, for each selected tone, electromagnetic radiation is output at a frequency that is based on a pitch class of the selected tone, and at an intensity/saturation that is based on an amplitude of the selected tone. In other words, to recreate the sensation of the relative loudness of a sound, a saturation value of the color is controlled based on the amplitude of the sound. In this way, a louder sound produces a more saturated color, while a softer sound produces a less saturated color. An example is provided below with reference to FIG. 10.

FIG. 10 is a table 1000 that lists frequencies and notes/pitches of tones 902*a* through 902*g*. Column 1002 lists corresponding frequencies within visible electromagnetic spectrum 204 of FIG. 2, which may be output at 806.

The frequency/wavelength of a given channel will typically change over time as the frequency content of an input sound changes. Thus, 806 in FIG. 8 may be performed repeatedly and/or continuously.

At 808, for each of one or more of the selected tones, one or more tactile devices are stimulated at a frequency that is based on the pitch class of the selected tone, and/or a of the harmonic(s) of the tone, and at an amplitude that is based on an amplitude of the selected tone. In other words, the intensity or amplitude of human perceptible tactile vibrations may be controlled based on the loudness of the sound.

In an embodiment, the one or more tactile devices are stimulated at a fundamental frequency of a fundamental one of the selected tones. An example is provided in FIG. 11. FIG. 11 is a table 1100 that includes features of table 1000 of FIG. 10, and further includes a column 1102 that lists a fundamental frequency of selected tone 902*a* at which to stimulate one or more tactile devices.

In another embodiment, each of multiple sets of one or more tactile devices is stimulated at fundamental frequencies, and/or a harmonic(s), of a respective one of the selected tones. An example is provided in FIG. 12. FIG. 12 is a table 1200 in which column 1102 of table 1100 is further populated with fundamental frequencies of remaining ones of selected tones 902*b* through 902*g*.

Returning to FIG. 8, at 810, for each of one or more of the selected tones, one or more cymatic devices are stimulated at a frequency that is based on the pitch class of the selected tone, and at an amplitude that is based on an amplitude of the selected tone. In an embodiment, the one or more cymatic devices include a cymatic simulator (e.g., a computer program that includes instructions to cause a processor to generate a cymatic image based on a frequency and amplitude of a selected tone).

In an embodiment, one or two of 806, 808, and 810 are omitted from method 800.

One or more features disclosed herein may be implemented in, without limitation, circuitry, a machine, a computer system, a processor and memory, a computer program encoded within a computer-readable medium, and/or combinations thereof. Circuitry may include discrete and/or integrated circuitry, application specific integrated circuitry (ASIC), a system-on-a-chip (SOC), and combinations thereof.

Figure 13:
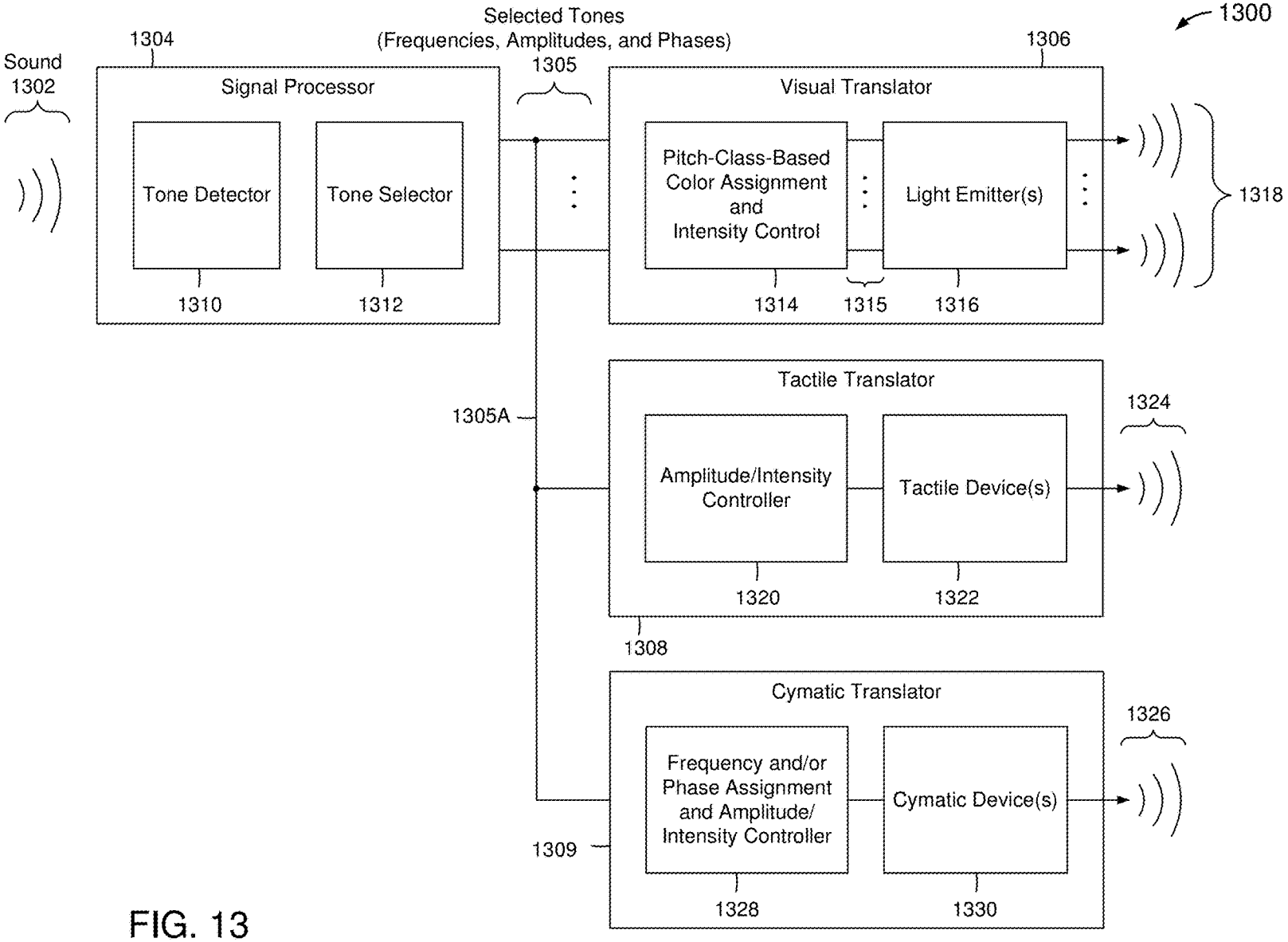
FIG. 13 is a block diagram of a system to convert acoustic vibrations or sound to visible light, tactile vibrations, and/or cymatic designs or images.

FIG. 13 is a block diagram of a system 1300 to convert acoustic vibrations, illustrated here as sound 1302, to visible light (e.g., colors) 1318, tactile vibrations 1324, and/or cymatic designs or images 1326.

System 1300 includes a signal processor 1304 that includes a tone detector 1310 to detect tones of sound 1302, and amplitudes of the tones. Tone detector 1310 may be configured to perform a Fast Fourier Transform (FFT) to detect the tones of sound 1302. Tone detector 1310 may include one or more microphones to convert acoustic vibrations of sound 1302 to electric signals.

Signal processor 1304 further includes a tone selector 1312 to select a plurality of the detected tones. Tone selector 1312 may be configured to select a predetermined number of the detected tones. Tone selector 1312 may be configurable to permit a user to specify the predetermined number of tones to select.

System 1300 further includes a visual translator 1306 to translate selected tones 1305 to respective channels of visible light 1318. Visual translator 1306 includes a pitch-class-based color assignment and intensity control engine (engine) 1314 to transform each selected tone 1305 to a frequency of electromagnetic radiation within visual spectrum 204 (FIG. 2), based on the pitch class of the respective selected tone 1305.

Engine 1314 is configured to output a pre-determined number of channels 1315 of information, each corresponding to respective one of selected tones 1305.

Engine 1314 is further configured to control an intensity or saturation of each channel 1315 of electromagnetic radiation based on the amplitude of the respective selected tone 1305.

Engine 1314 may be configured to classify a tone as a particular note, or as belonging to a particular pitch class, if the tone is within a range of a nominal frequency of the note or pitch class.

Each selected tone 1305, or channel 1315, may represent a fundamental tone or an overtone of sound 1302. By calculating the color of the fundamental tone and overtones, along with amplitude controlling their respective saturation, the precise timbre of each instrument may be reproduced in a visual and/or tactile manner. This provides an accurate visual and/or tactile reproduction of subtle nuances between different instruments and/or voices. This may provide a non-hearing individual with an ability to see and/or feel the sound of each instrument playing music.

In an embodiment, pitch-class-based color assignment engine 1314 is configured to transpose selected tones 1305 in an exponential fashion, such as by doubling the octave of the respective tone until it falls with visible spectrum 204 (FIG. 2). The frequency of electromagnetic radiation X may be computed with EQ. (1).

$$X=f\times 2^{j}, \qquad \text{EQ. (1)}$$

where f is a frequency of a sound to be transformed, and where j is an integer between 37 and 44, depending upon an octave of f.

EQ. (1) may be computed for each selected tone 1305.

The corresponding wavelength, λ, may be computed with EQ. (2).

$$\lambda=C/X, \qquad \text{EQ. (2)}$$

where C=speed of light.

Visual translator 1306 further includes light projectors 1316, each to project electromagnetic radiation for a respective one of channels 1315 as visible light 1318, to create a fully immersive environment, referred to herein as virtual synesthesia.

Light projectors 1316 may be configured to project each channel of visible light 1318 with an intensity that is based on the amplitude of the respective selected tone 1305.

Light projectors 1316 may be include 2-dimensional and/or 3-dimensional projectors. A 2-dimensional projector may include a computer-driven monitor or display, and/or a projector to project light toward a 2-dimensional surface. A 3-dimensional projector may include a holographic projector and/or a projector to project light toward a 3-dimensional surface (e.g., stages, screens, and/or buildings). Light projectors 1316 may include, without limitation, light-emitting diodes (LEDs). Light projectors 1316 are not limited to the foregoing examples.

System 1300 further includes a tactile translator 1308 to translate a fundamental, and/or a harmonic(s) of one of selected tones 1305 (i.e., tone 1305A), to tactile vibrations 1324.

Tactile translator 1308 includes an amplitude/intensity controller 1320 to transform tone 1305A to a frequency within tactile spectrum 206 (FIG. 2), based on the pitch class of tone 1305A, such as illustrated in column 1102 of table 1100 (FIG. 11).

Tactile translator 1306 further includes one or more tactile devices 1322 to emit tactile vibrations for tone 1305A as tactile vibrations 1324.

Tactile device(s) 1322 may include tactile transducers that produce vibrations at frequencies of signals provided to the tactile transducers. Due to recent improvements in the accuracy and fidelity of tactile transducers, tactile transducers are well suited to reproduce the vibratory signature for various musical instruments such as violin, guitar, and the human voice.

Tactile device(s) 1322 may be positioned within or throughout an audience (e.g., in a mirror image of an on-stage ensemble), to provide a sensation of being on-stage with performers. Another embodiment may include several tactile transducers in a single chair, each vibrating at the fundamental or harmonic of a tone, providing an even more immersive experience.

System 1300 further includes a cymatic translator 1309 to translate tones 1305A to designs or images 1326. Cymatic translator 1309 includes one or more cymatic devices 1322 to emit or display cymatic designs or images 1326. Cymatic translator 1309 further includes a frequency and phase assignment and amplitude/intensity controller (controller) 1328 to transform tone 1305A to a frequency and amplitude suitable for cymatic device(s) 1330, based on the pitch class of tone 1305A.

In an embodiment, one or two of visual translator 1306, tactile translator 1308, and cymatic translator 1309 may be omitted.

Figure 14:
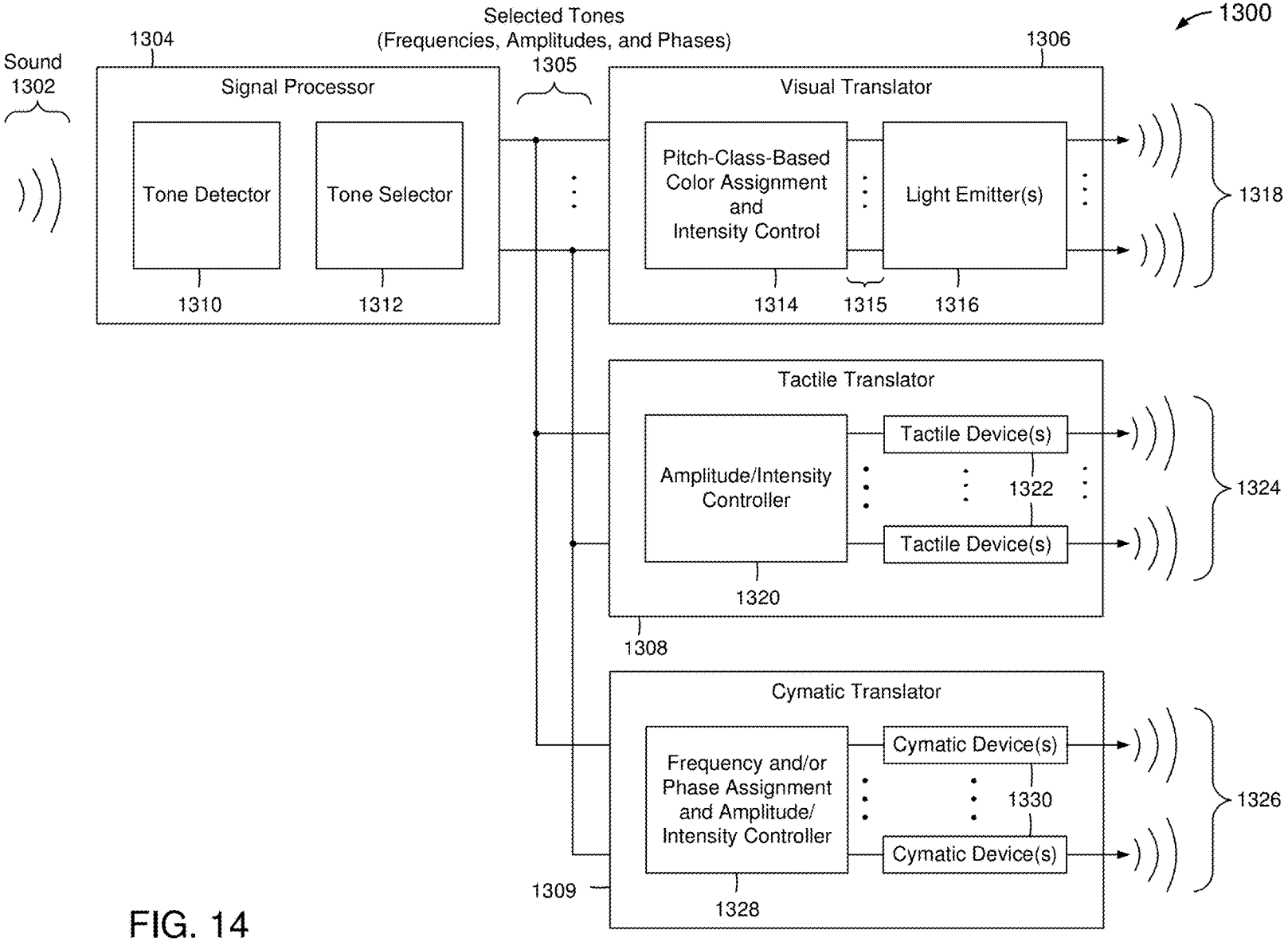
FIG. 14 is a block diagram of another embodiment of the system of FIG. 13, in which a tactile translator is configured to output tactile vibrations for each selected tone, and a cymatic translator is configured to output cymatic forms/images for each selected tone.

FIG. 14 is a block diagram of another embodiment of system 1300, in which tactile translator 1308 is configured to output tactile vibrations 1324 for each selected tone 1305, and cymatic translator 1309 is configured to output cymatic forms/images 1326 for each selected tone 1305.

Figure 15:
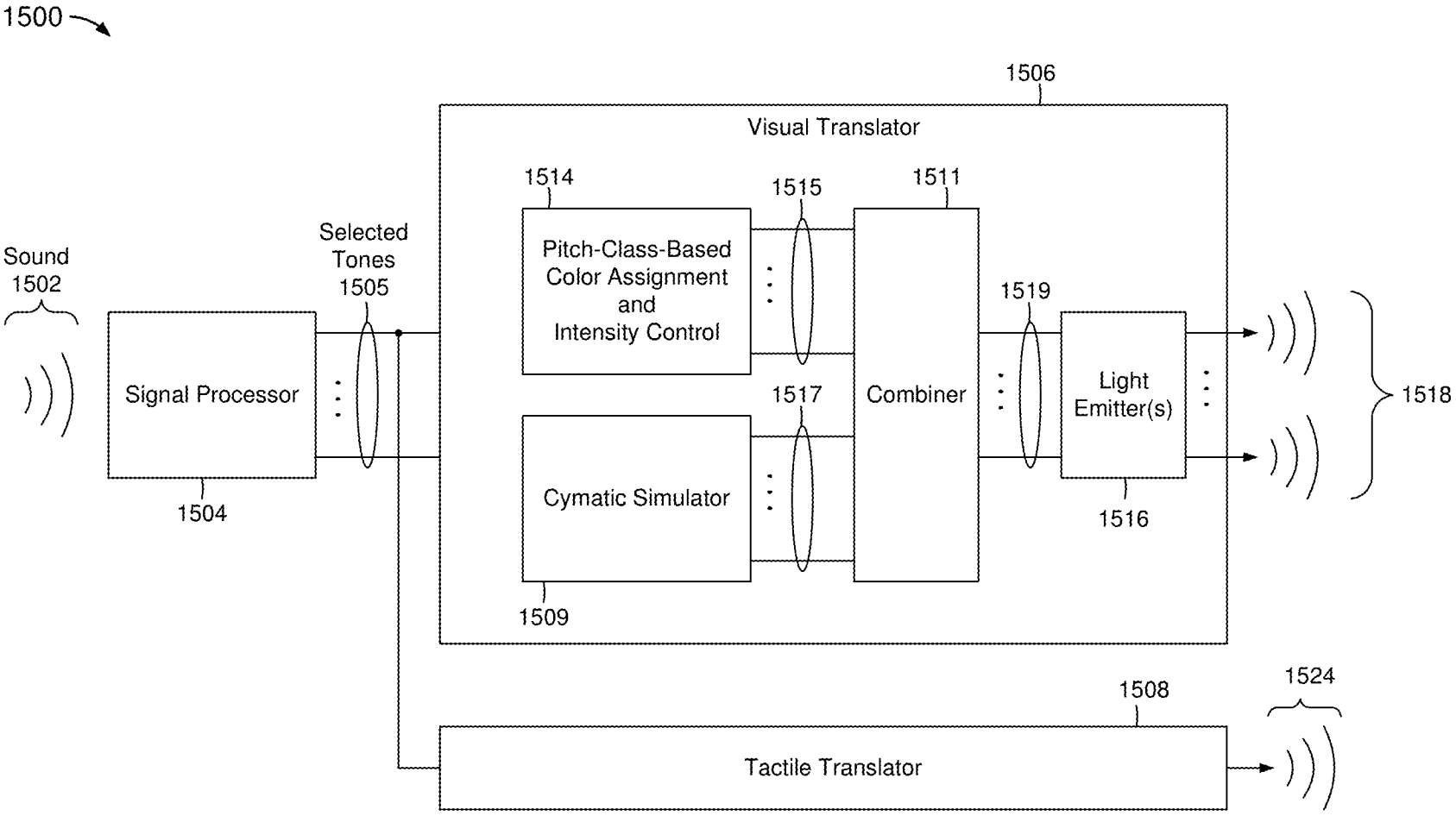
FIG. 15 is a block diagram of a system to convert acoustic vibrations or sound to cymatic images of various colors.

FIG. 15 is a block diagram of a system 1500 to convert acoustic vibrations or sound 1502, to visible light (e.g., colors) 1518.

System 1500 includes a signal processor 1504 to select a predetermined number of tones 1505 of sound 1502, such as described in one or more examples herein.

System 1500 further includes a visual translator 1506 to convert acoustic vibrations or sound 1502, to colored cymatic forms or images 1518.

Visual translator 1506 includes a pitch class-based color assignment and intensity control engine (engine) 1514 to translate selected tones 1505 to respective channels of visible light 1515, such as described in one or more examples herein.

Visual translator 1506 further includes a cymatic simulator 1509 to translate selected tones 1505 to respective channels of cymatic forms or images 1517, such as described in one or more examples herein.

Visual translator 1506 further includes a combiner 1511 to combine channels of visible light 1515 with respective channels of cymatic forms or images 1517, to provide channels of colored cymatic forms or images 1519.

Visual translator 1506 further includes light emitters 1516 to generate colored cymatic forms or images 1518 from channels of colored cymatic forms or images 1519.

System 1500 may further include a tactile translator 1508 to generate tactile vibrations 1524 from one or more selected tones 1505, such as described in one or more examples herein.

Figure 16:
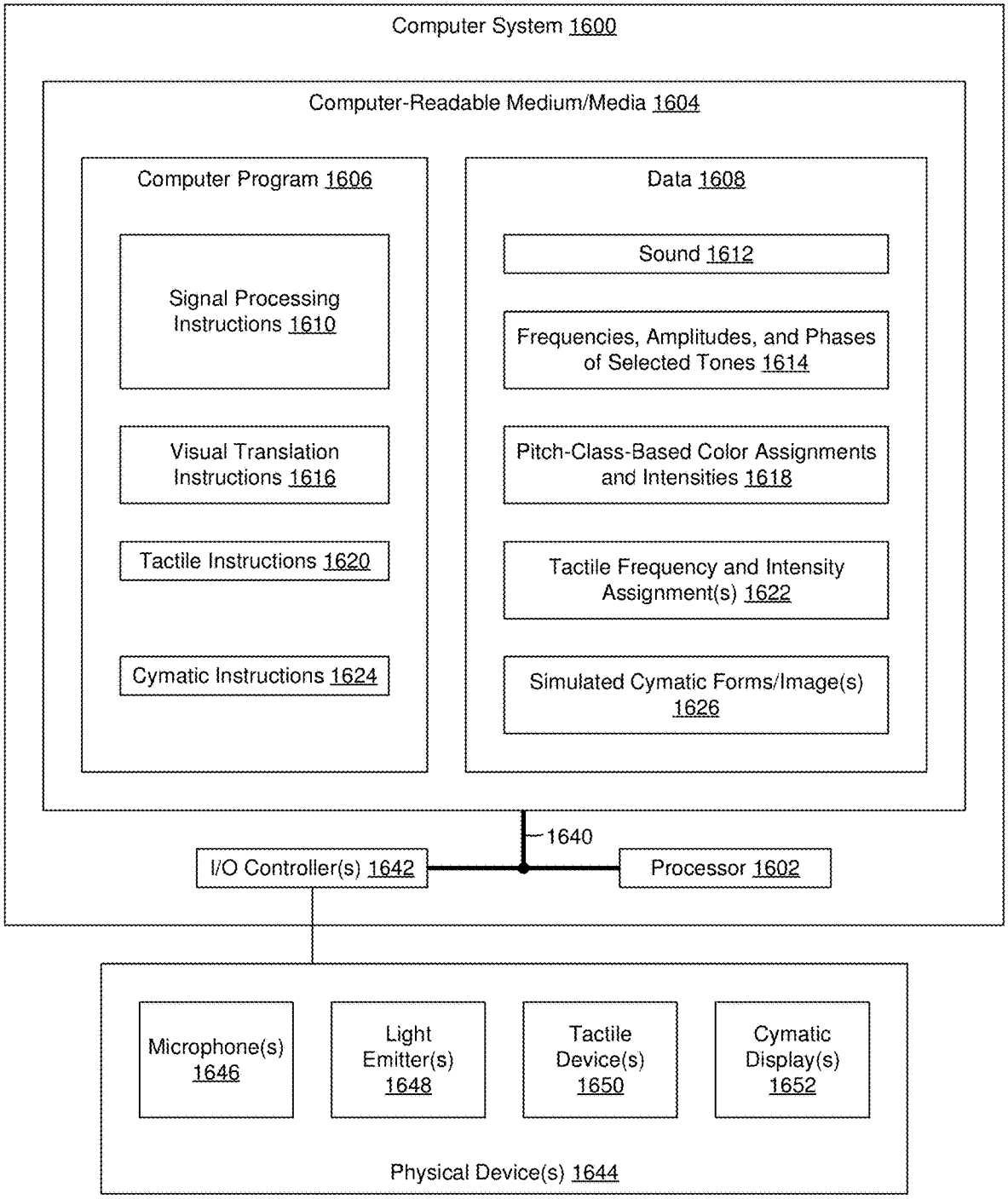
FIG. 16 is a block diagram of a computer system configured to transform sound to visual and/or tactile stimuli.

FIG. 16 is a block diagram of a computer system 1600, configured to transform sound to visual and/or tactile stimuli. Computer system 1600 may represent an example embodiment or implementation of system 1300 in FIG. 13 or FIG. 4, and/or of system 1500 in FIG. 15.

Computer system 1600 includes one or more processors, illustrated here as a processor 1602, to execute instructions of a computer program 1606 encoded within a computer-readable medium 1604. Computer-readable medium 1604 may include a transitory or non-transitory computer-readable medium.

Computer-readable medium 1604 further includes data 1608, which may be used by processor 1602 during execution of computer program 1606, and/or generated by processor 1602 during execution of computer program 1606.

Computer program 1606 includes signal processing instructions 1610 to cause processor 1602 to detect tones, amplitudes and phases of sound 1612, and to select a subset 1614 of the detected tones, such as described in one or more examples herein.

Computer program 1606 further includes visual translation instructions 1614 to cause processor 1602 to cause processor 1602 to assign visual colors and intensities 1618 based on pitch classes and amplitudes of the selected tones 1614, such as described in one or more examples herein.

Computer program 1606 further includes tactile instructions 1620 to cause processor 1602 to assign tactile frequencies and intensities 1622 based on the pitch class and amplitude of one or more selected tones 1614, such as described in one or more examples herein.

Computer program 1606 further includes cymatic instructions 1624 to cause processor 1602 to generate cymatic forms or images 1626 based on the pitch class and amplitude of one or more selected tones 1614, such as described in one or more examples herein.

In an embodiment, one or two of visual translation instructions 1614, tactile translation instructions 1620, and cymatic instructions 1624 may be omitted.

Computer system 1600 further includes communications infrastructure 1640 to communicate amongst devices and/or resources of computer system 1600.

Computer system 1600 further includes an input/output (I/O) device 1642 to interface with one or more other devices or systems, such as physical devices 1644. In the example of FIG. 16, physical devices 1644 include a microphone(s) 1646 to capture sound 1612 as electric signals, a light emitter(s) 1648 to emit pitch-class-based color assignments and intensities 1618, a tactile device(s) 1650 to receive pitch-class-based tactile frequency assignments 1622, and a cymatic display(s) 1652 to display or project simulated cymatic forms or images 1626.

As disclosed herein, by analyzing a sound using Fourier analysis and a series of mathematical functions, the data of a sound (frequency, amplitude, phase and timbre), may be used to create a virtual synesthesia-like effect, therefore finding a color of sound and/or a feeling of sound.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What is claimed is:

1. A method, comprising:

detecting multiple tones of a recorded sound with a signal processor, including a fundamental tone and multiple overtones of the recorded sound;

selecting a plurality of the detected tones with the signal processor; and for each selected tone, controlling a light emitter, with a processor and memory, to output visible electromagnetic radiation at a frequency that is based on a pitch class of the selected tone and at an intensity that is based on an amplitude of the selected tone, to provide a visual depiction of a frequency content and an envelope of the recorded sound.

2. The method of claim 1, further including, for each selected tones:

stimulating a tactile device, with the processor and memory, at a frequency that is based on the pitch class of the selected tone and at an intensity that is based on the amplitude of the selected tone.

3. The method of claim 1, further including:

controlling a cymatic device with the processor and memory to generate a cymatic image of the plurality of the selected tones based on frequencies, the amplitudes, and phases of the selected tones.

4. The method of claim 1, wherein the overtones include a harmonic of the fundamental tone and a partial of the fundamental tone, and wherein:

the detecting multiple tones includes detecting the fundamental tone, the harmonic, and the partial;

the selecting includes selecting the fundamental and/or the harmonic, and selecting the partial; and the controlling includes controlling the light emitter to output visible electromagnetic radiation at a first frequency associated with the fundamental tone and the harmonic, and controlling the light emitter to output visible electromagnetic radiation at a second frequency that is associated with the partial.

5. The method of claim 1, wherein the outputting electromagnetic radiation includes, for each selected tone:

controlling the light emitter to output the visible electromagnetic radiation at a frequency that is equal to a frequency of the selected tone multiplied by $2^j$, where j is an integer between 37 and 44 depending upon an octave of the selected tone.

6. The method of claim 1, wherein the controlling a light emitter includes, for each selected tone:

doubling an octave of the selected tone until a result of the doubling is within a spectrum of visible electromagnetic radiation.

7. The method of claim 1, wherein the controlling a light emitter includes, for each selected tone:

controlling a saturation value of the visible electromagnetic radiation based on the amplitude of the selected tone.

8. An apparatus, comprising:

a signal processor configured to detect multiple tones of a recorded sound, including a dominant tone and multiple overtones of the recorded sound, and to select a plurality of the detected tones; and a processor and memory configured to, for each selected tones, control a light emitter to output visible electromagnetic radiation at a frequency that is based on a pitch class of the selected tone and at an intensity that is based on an amplitude of the selected tone, to provide a visual depiction of a frequency content and an envelope of the recorded sound.

9. The apparatus of claim 8, wherein the processor and memory are further configured to, for each selected tones:

stimulate a tactile device at a frequency that is based on the pitch class of the selected tone and at an intensity that is based on the amplitude of the selected tone.

10. The apparatus of claim 8, wherein the processor and memory are further configured to:

control a cymatic device to generate a cymatic image of the selected tones based on the frequencies, the amplitudes phases of the selected tones.

11. The apparatus of claim 8, wherein the overtones include a harmonic of the fundamental tone and a partial of the fundamental tone, and wherein:

the signal processor is further configured to detect the fundamental tone, the harmonic, and the partial;

the processor and memory are further configured to select the fundamental and/or the harmonic, and select the partial; and the processor and memory are further configured to control the light emitter to output visible electromagnetic radiation at a first frequency associated with the fundamental tone and the harmonic, and to control the light emitter to output visible electromagnetic radiation at a second frequency that is associated with the partial.

12. The apparatus of claim 8, wherein the processor and memory are further configured to, for each selected tone:

control the light emitter to output the visible electromagnetic radiation at a frequency that is equal to a frequency of the selected tone multiplied by $2^j$, where j is an integer between 37 and 44 depending upon an octave of the selected tone.

13. The apparatus of claim 8, wherein the processor and memory are further configured to, for each selected tone:

double an octave of the selected tone until a result of the doubling is within a spectrum of visible electromagnetic radiation.

14. The apparatus of claim 8, wherein the processor and memory are further configured to, for each selected tone:

control a saturation value of the visible electromagnetic radiation based on the amplitude of the selected tone.

15. A non-transitory computer readable medium encoded with a computer program that includes instructions to cause a processor to:

detect multiple tones of a recorded sound, including a dominant tone and multiple overtones of the recorded sound;

select a plurality of the detected tones; and for each selected tones, control a light emitter to output visible electromagnetic radiation at a frequency that is based on a pitch class of the selected tone and at an intensity that is based on an amplitude of the selected tone, to provide a visual depiction of a frequency content and an envelope of the recorded sound.

16. The computer-readable medium of claim 15, further including instructions to cause the processor to, for each selected tone:

stimulate a tactile device at a frequency that is based on the pitch class of the selected tone and at an intensity that is based on the amplitude of the selected tone.

17. The computer-readable medium of claim 15, further including instructions to cause the processor to:

control a cymatic device to generate a cymatic image of the selected tones based on the frequencies, the amplitudes, and phases of the selected tones.

18. The non-transitory computer readable medium of claim 15, wherein the overtones include a harmonic of the fundamental tone and a partial of the fundamental tone, further including instructions to cause the processor to:

detect the fundamental tone, the harmonic, and the partial;

select the fundamental and/or the harmonic, and select the partial; and control the light emitter to output visible electromagnetic radiation at a first frequency associated with the fundamental tone and the harmonic, and to control the light emitter to output visible electromagnetic radiation at a second frequency that is associated with the partial.

19. The non-transitory computer readable medium of claim 15, further including instructions to cause the processor to, for each selected tone:

control the light emitter to output the visible electromagnetic radiation at a frequency that is equal to a frequency of the selected tone multiplied by $2^j$, where j is an integer between 37 and 44 depending upon an octave of the selected tone.

20. The non-transitory computer readable medium of claim 15, further including instructions to cause the processor to, for each selected tone:

double an octave of the selected tone until a result of the doubling is within a spectrum of visible electromagnetic radiation.

* * * * *